US006568380B1

(12) United States Patent
Niwa et al.

(10) Patent No.: US 6,568,380 B1
(45) Date of Patent: May 27, 2003

(54) MEDAL GAME MACHINE

(75) Inventors: Shinya Niwa, Ota-ku (JP); Shinichi Odake, Ota-ku (JP)

(73) Assignee: Namco Ltd., Tokyo (JP)

( * ) Notice: Subject to any disclaimer, the term of this patent is extended or adjusted under 35 U.S.C. 154(b) by 0 days.

(21) Appl. No.: 09/830,072

(22) PCT Filed: Aug. 25, 2000

(86) PCT No.: PCT/JP00/05746

§ 371 (c)(1),
(2), (4) Date: May 21, 2001

(30) Foreign Application Priority Data

Aug. 31, 1999 (JP) ..... 11-246208
Feb. 24, 2000 (JP) ..... 2000-048365

(51) Int. Cl.[7] ..... A63F 9/00

(52) U.S. Cl. ..... 124/16; 124/31; 124/42; 273/126 R

(58) Field of Search ..... 124/16, 26, 27, 124/31, 32, 42; 273/126 R, 126 A, 440, 454, 129 R, 129 V, 129 W

(56) References Cited

U.S. PATENT DOCUMENTS 4,694,815 A * 9/1987 Hung ..... 124/27
5,613,482 A * 3/1997 Thai et al. ..... 124/16
5,667,217 A * 9/1997 Kelly et al. ..... 273/126 R
5,890,479 A * 4/1999 Morin ..... 124/31
6,390,471 B2 * 5/2002 Shinbo et al. ..... 283/126 A

FOREIGN PATENT DOCUMENTS

| | | |
|---|---|---|
| JP | U 1-175380 | 12/1989 |
| JP | A 8-229233 | 9/1996 |
| JP | A 8-309023 | 11/1996 |
| JP | A 10-137438 | 5/1998 |
| JP | A 11-146977 | 6/1999 |

* cited by examiner

*Primary Examiner*—Marguerite McMahon
(74) *Attorney, Agent, or Firm*—Oliff & Berridge, PLC

(57) ABSTRACT

The present invention provides a medal game machine that makes it possible, for a medal to move forward with good directionality, thus increasing the playability of an aiming game. The configuration is such that a medal (14) fired from a shooting device (16) is used to shoot at a target. The shooting device (16) comprises a shooting section (24) that loads the medal (14) in a vertical orientation and a push-out means (30) that pushes out and fires the medal (14) loaded into the shooting section (24) A pressing roller (40) that presses against the upper portion of the medal (14) that is loaded into the shooting section (24) is provided in the shooting section (24) so that, when the medal (14) is being pushed out by the push-out means (30), it is shot out escaping from the pressing roller (40).

19 Claims, 10 Drawing Sheets

MEDAL GAME MACHINE

TECHNICAL FIELD

The present invention relates to a medal game machine and, in particular, to a medal game machine in which medals are used to shoot at targets.

BACKGROUND OF ART

A known generic type of game machine is a medal game machine in which medals are used.

An example of such a medal game machine is one which makes it possible to play a pusher game in which medals jostle on a game field and medals fall.

In such a medal game machine, the configuration is such that medals that are made to move along rails provided on a slope are sent into the game field.

However, simply sending in medals by using rails raises problems in that there is no directionality to the medals so the game relies on pure luck, nothing happens but medals enter the game field, and the game is not very interesting, which all detract from the playability of the game.

DISCLOSURE OF THE INVENTION

An objective of the present invention is to provide a medal game machine that makes it possible for a medal to move forward with good directionality, thus increasing the playability of an aiming game.

In order to achieve the above objective, a medal game machine in accordance with the present invention relates to a medal game machine that uses medals fired from a shooting device to shoot at a target, (1) wherein the shooting device comprises a shooting section which loads a medal in a vertical orientation and a shooting means which shoots a medal that has been loaded into the shooting section, wherein the shooting section is provided with positioning means which positions a medal that has been loaded into the shooting section, when the medal is being shot by the shooting means, and wherein the medal is shot past the positioning means.

This aspect of the present invention makes it possible to position a medal by the positioning means, when a medal that has been loaded in a vertical orientation into the shooting section is to be shot by the shooting means provided in the shooting device, so that the medal can be shot past that positioning means and can be made to move forward with directionality, like a bullet, which makes it possible to aim at targets and thus make it possible to enjoy aiming at targets within the medal game and also increase the playability of the game.

The positioning of the medal by the positioning means also comprises control such that the medal loaded into the shooting section is not spurred out passing the shooting section.

In addition, making it possible to aim medals in this manner ensures that it becomes possible to enjoy aiming at targets with various different medal game machines.

(2) Another medal game machine in accordance with the present invention relates to a medal game machine that uses medals fired from a shooting device to shoot at a target, wherein the shooting device comprises a shooting section which loads a medal in a vertical orientation and a push-out means which pushes out and shoots a medal that has been loaded into the shooting section, wherein the shooting section is provided with pressing means which presses against an upper portion or a lower portion of a medal that has been loaded into the shooting section, when the medal is being pushed out by the push-out means, and wherein the medal is shot past the pressing means.

When a medal that has been loaded into the shooting section is being pushed out by the push-out means provided in the shooting device, this aspect of the present invention makes it possible to impart a sufficiently large rotational force to the medal that is being shot past the pressing means by pressing with the pressing means against the upper portion or lower portion of the medal loaded in the shooting section in a state in which it absorbs the pushing force of the push-out means, so that the medal can be made to move forward with directionality, like a bullet, which makes it possible to aim at targets and thus make it possible to enjoy aiming at targets within the medal game and also increase the playability of the game.

In addition, making it possible to aim medals in this manner ensures that it becomes possible to enjoy aiming at targets with various different medal game machines.

(3) In such a case, the pressing means may be provided at an upper part of the shooting section, and a sliding-prevention means for preventing the medal from sliding may be provided at a lower part of the shooting section.

This configuration makes it possible to impart a rotational drive to the medal, by preventing sliding of the lower portion of the medal by the sliding-prevention means provided at a lower part of the shooting section and by shooting the medal past the pressing means provided at an upper part thereof, thus increasing the straight running characteristic thereof.

(4) Alternatively, the pressing means may be provided at a lower part of the shooting section, and a sliding means for allowing the medal to slide may be provided at an upper part of the shooting section.

This configuration makes it possible impart a rotational drive to the medal, by allowing the upper portion of the medal to slip by the sliding means provided at an upper part of the shooting section while shooting the medal past the pressing means provided at a lower part thereof, thus increasing the straight running characteristic thereof.

(5) In addition, the pressing means may be a pressing roller that is energized in a medal-pressing direction by a spring.

This configuration makes it possible to further increase the rotational force and straight running characteristic of a medal that has gone over the pressing roller and been pushed forward by the spring that energizes the pressing roller.

(6) Further, an attachment position of the spring may be adjustable so as to adjust the pressing force of the pressing roller.

This makes it possible to adjust the speed at which the medal is shot out by adjusting the pressing force of the pressing roller.

(7) In the present invention, the shooting section may be provided with a small-diameter medal ejection means that ejects a small-diameter medal, which is smaller than an-outer diameter of an authorized medal, to an exterior from the shooting section before the small-diameter medal is shot, when a supplied medal is the small-diameter medal.

This configuration makes it possible to reliably avoid the use of medals- that are of a smaller diameter than authorized medals, by ejecting such small-diameter medals to the exterior by the small-diameter medal ejection means provided in the shooting section, thus reliably preventing the deliberate use of small-diameter medals.

(8) In such a case, the small-diameter medal ejection means may include a small-diameter medal ejection hole formed in one side surface of the shooting section and an ejection member provided on another side surface at a position corresponding to the small-diameter medal ejection hole, for pushing a side surface of a small-diameter medal towards the small-diameter medal ejection hole.

This makes it possible to reliably eject small-diameter medals to the exterior, by pushing small-diameter medals out by the ejection member to the ejection hole, and also enables a simple structure and a reduction in cost.

(9) Furthermore in such a case, the small-diameter medal ejection means may have an aperture height adjustment means which adjusts an aperture height of the small-diameter medal ejection hole.

This makes it possible to set the size of small-diameter medals that are to be ejected in accordance with the size of authorized medals, in a simple and reliable manner, by adjusting the aperture height of the small-diameter medal ejection hole by the aperture height adjustment means.

(10) In the present invention, the shooting device may comprise a medal insertion section for loading medals into the shooting section, a large-diameter medal rejection means which rejects a large-diameter medal that is larger than an outer diameter of an authorized medal may be provided in the medal insertion section, and the large-diameter medal rejection means may adjust a size of a medal to be rejected according to a size of an authorized medal.

This configuration makes it possible to reliably reject any large-diameter medal that is larger than an authorized medal, by the large-diameter medal rejection means provided in the medal insertion section, so that deliberate use of large diameter medals can be prevented reliably. Moreover, it makes it possible to correspond with the size of authorized medals in a reliable manner by adjusting the large-diameter medal rejection means. This facilitates the use of various different medals of different sizes in various different stores in which medal game machines are installed.

(11) In accordance with the present invention, the medal game machine may further comprise:

a reflective plate disposed in an inclined state in front of the shooting device, for reflecting and displaying an image of a display on which is shown a target;

a medal running surface disposed below the reflective plate, enabling medals to pass under the reflective plate;

detection means disposed on the rear side of the reflective plate and above the medal running surface, and detecting the position through which a medal passes; and a result determination section which determines whether or not the position through which the medal passes matches the position of the target.

This configuration makes it possible to determine whether or not the medal hits the target by using the result determination means to determine a state in which the position at which a medal passes is at a position of a target, by shooting a medal that is aimed at a target displayed on the reflective plate, having the medal pass under the reflective plate while running on the medal running surface, then ensuring that the position at which it passes is detected by the detection means, thus creating a game that is interesting as a target game.

(12) In the present invention, the reflective plate may be a half-mirror so that a running state of a medal after passing the half-mirror is visible.

With this configuration, the running state of each medal after it has passed the half-mirror can be seen, making it possible to impart an realistic image of a medal striking a target in a virtual space, thus increasing the playability of the game.

BEST MODE FOR CARRYING OUT THE INVENTION

Embodiments of the present invention are described below with reference to the accompanying figures.

An embodiment of a medal game machine in accordance with the present invention is shown in FIGS. 1 to 7B.

Figure 1:
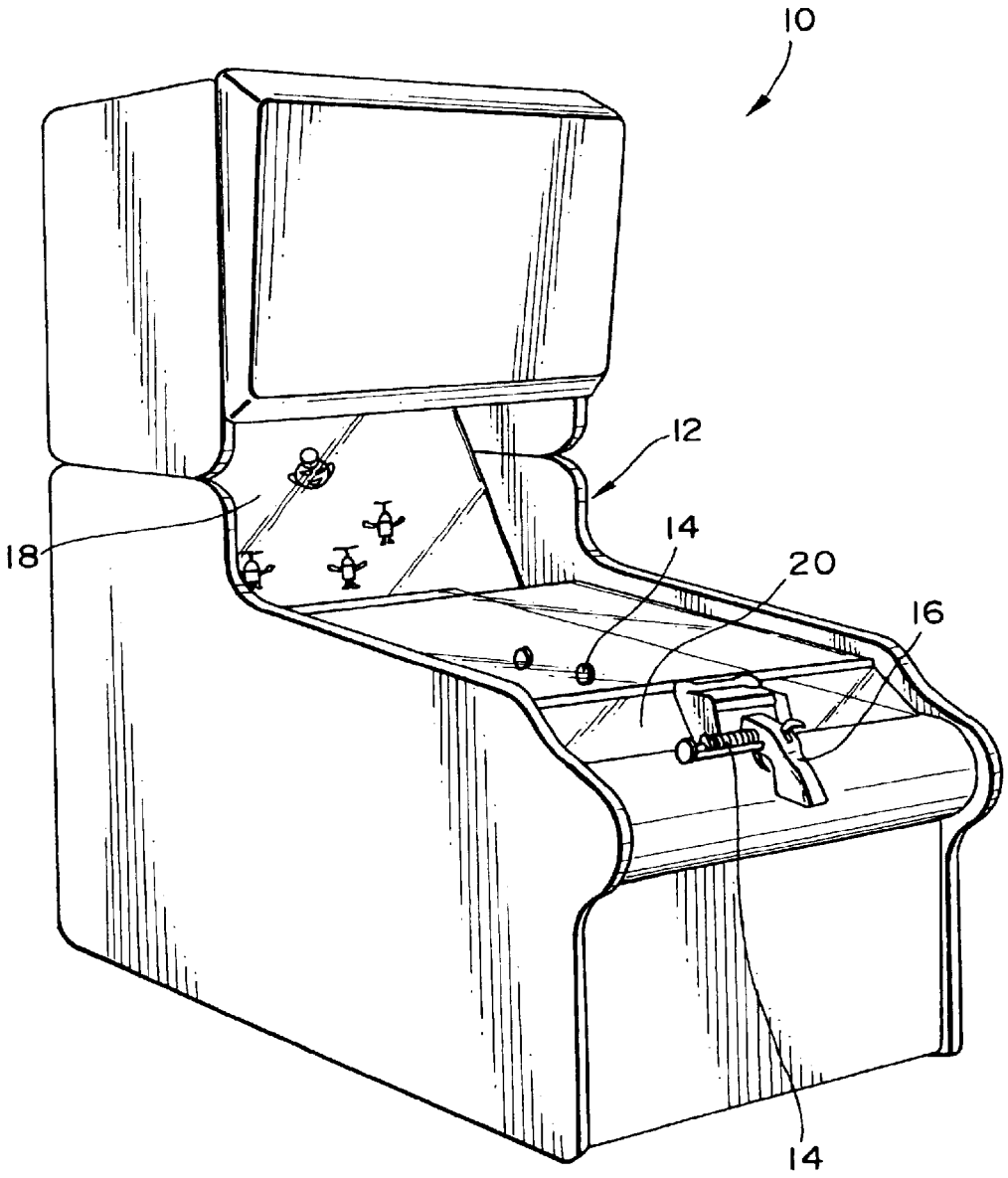
FIG. 1 is an overall perspective view of a medal game machine in accordance with an embodiment of the present invention.
Figure 2:
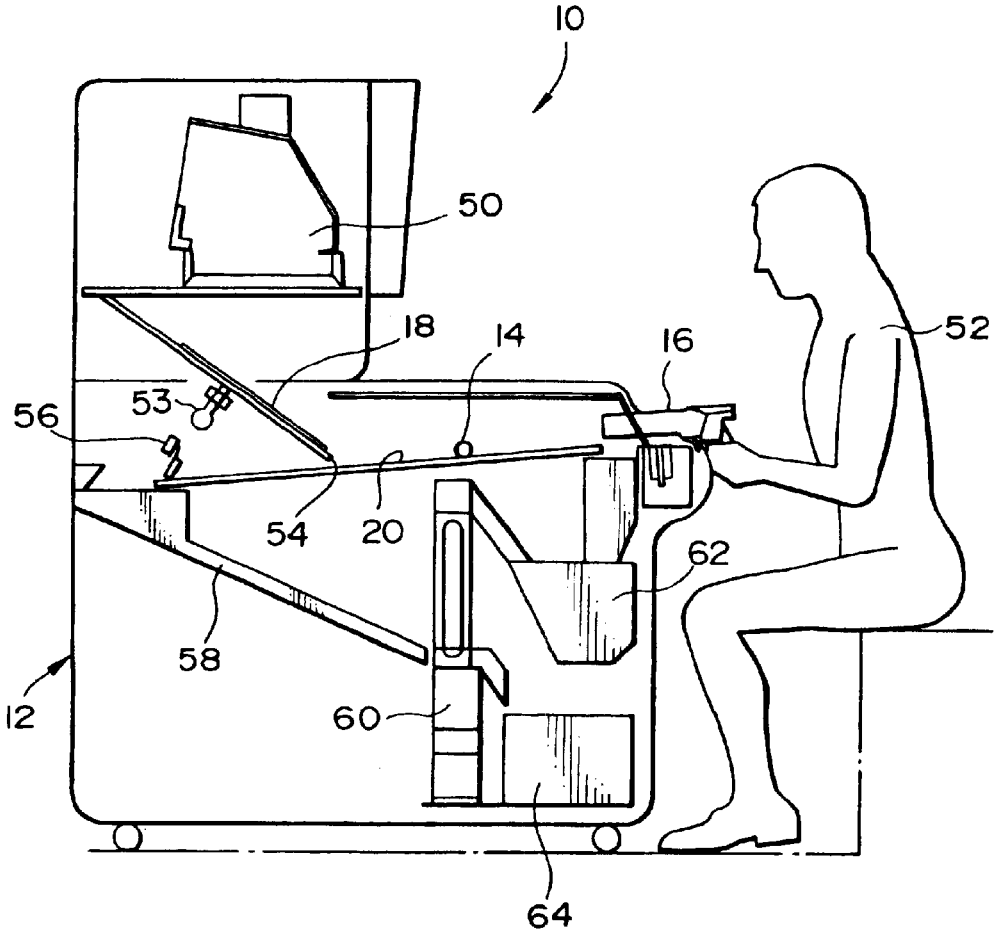
FIG. 2 is a schematic section through the game machine of FIG. 1.

This medal game machine 10 is provided with a shooting device 16 for medals 14 on a front side of a casing 12, a half-mirror 18 that acts as a reflective plate for displaying targets is provided in front thereof, and a medal running surface 20 is provided under the half-mirror 18, extending from the side of the shooting device 16 to the interior of the half-mirror 18, as shown in FIG. 1.

Figure 3:
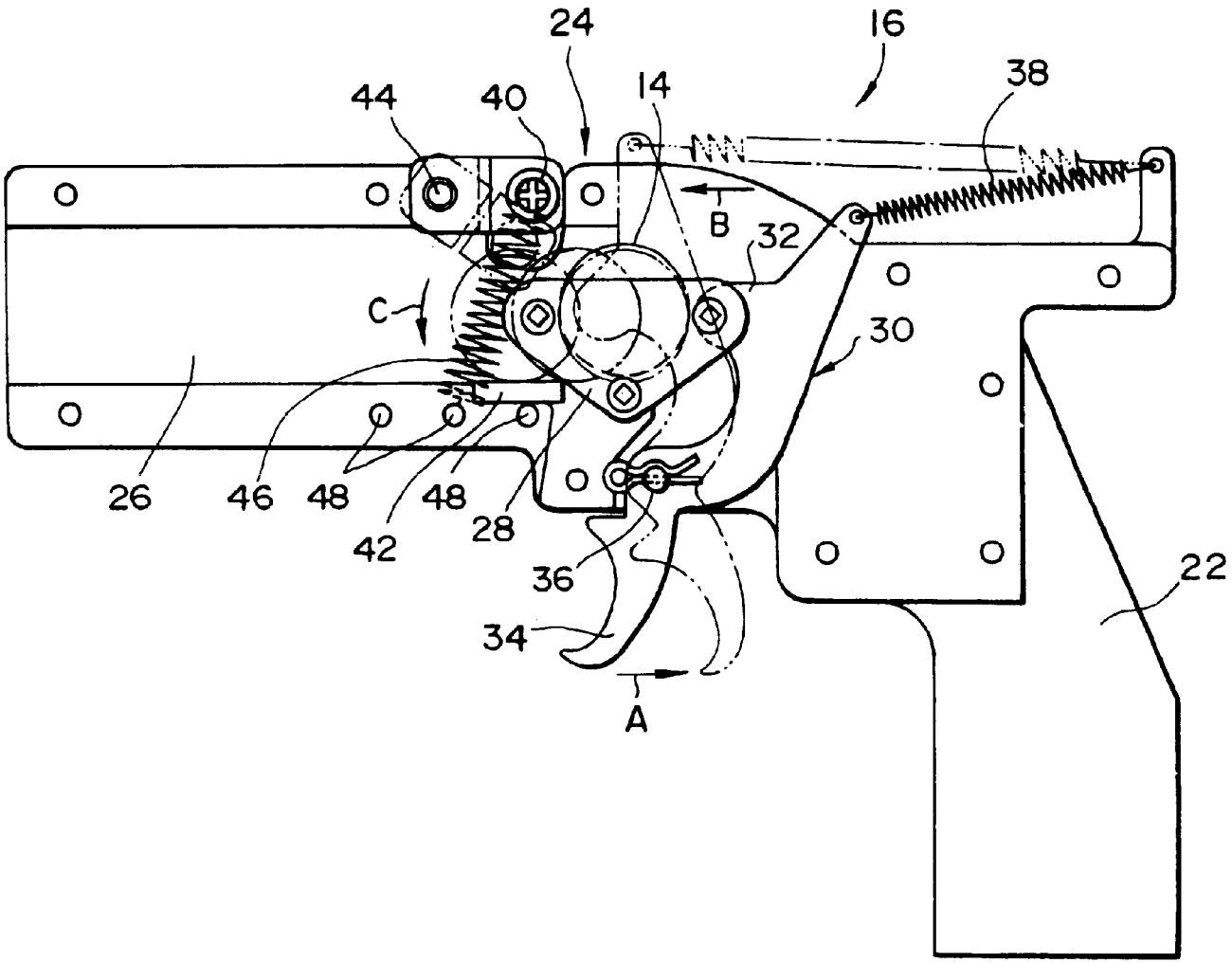
FIG. 3 is a side view of the shooting device shown in FIGS. 1 and 2.
Figure 4:
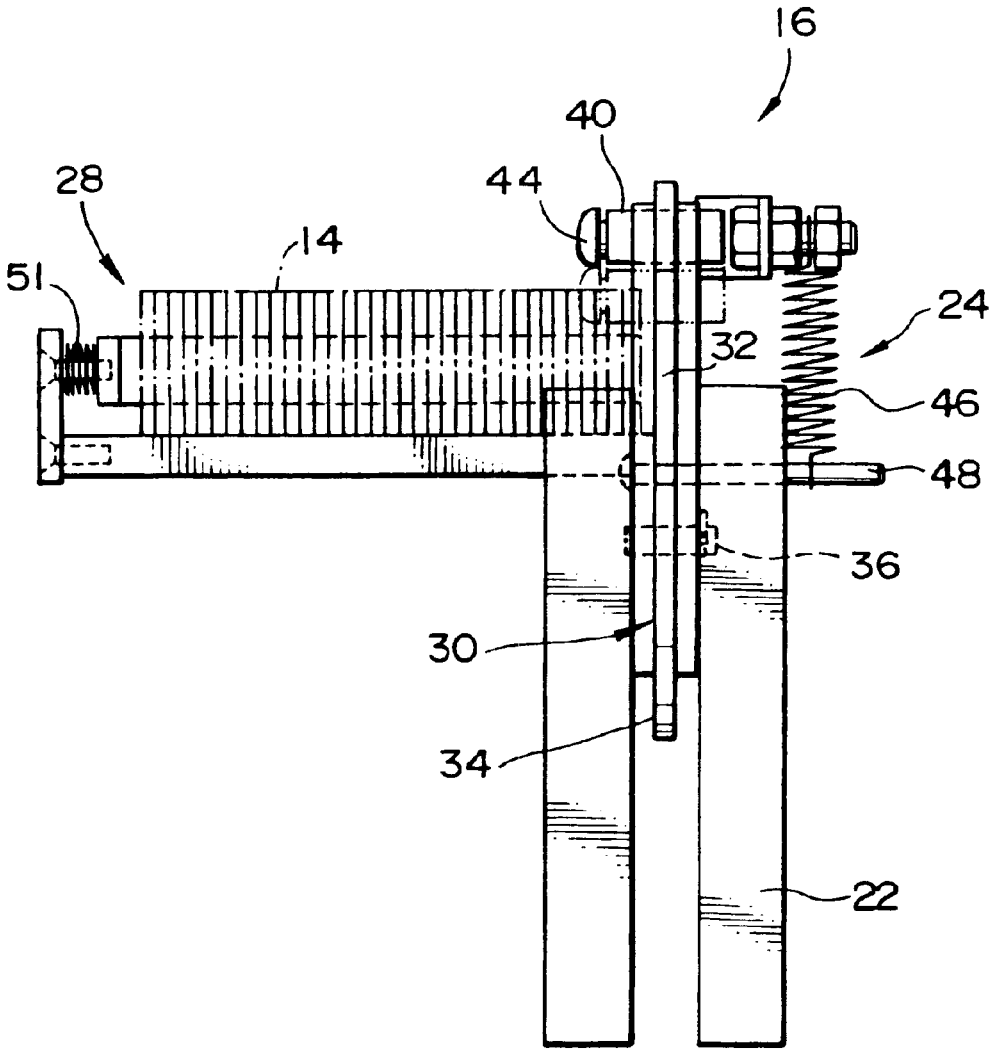
FIG. 4 is a side view as seen from the right side of FIG. 3.

The shooting device 16 is formed to simulate the shape of a hand-gun, as shown in FIGS. 3 and 4, and is provided with a grip 22, a shooting section 24, a shot running section 26, and a medal loading section 28.

The grip 22 has a shape that is easy for a hand to grasp and is designed in such a manner that aim can be obtained in a state in which that grip 22 is grasped.

The shooting section 24 is configured in such a manner that a medal 14 is loaded therein in a vertical orientation, and a push-out means 30 is provided at the rear side of this shooting section 24 to push out the medal 14 that is loaded into the shooting section 24 and fire it.

This push-out means 30 is in a state such that a push-out section 32 and a trigger 34 are formed integrally therewith, it is installed in such a manner that it can rotate about the center of a pin 36 and it is also in a state in which it is energized rearward by a spring 38 on the push-out section 32 side.

The configuration is such that the energizing force of the spring 38 is resisted by pulling the trigger 34 in the direction of the arrow A so that the push-out section 32 moves in the direction B in the figure to push out the medal 14;.

A pressing roller 40 is provided as a pressing means in an upper part of the shooting section 24, and a slip-proof rubber piece 42 is provided as a sliding-prevention means in a lower part thereof, to prevent the medal 14 sliding.

The pressing roller 40 is attached so as to be able to rotate up and down about a pin 44 and is in a state such that it is energized downward by a spring 46.

The slip-proof rubber piece 42 is arranged in a position corresponding to the pressing roller 40 so that when the upper portion of the medal 14 is in contact with the pressing roller 40, the slip-proof rubber piece 42 is in contact with the lower portion of the medal 14, making the lower portion of the medal unable to slide.

If the medal 14 is pushed out by the push-out means 30 as far as the position of the pressing roller 40, the upper portion of the medal 14 is pressed by the pressing roller 40 in a state in which it absorbs the pressing force of the push-out means 30. If the medal 14 is pushed out further by the push-out means 30, it resists the energizing force of the spring 46, the pressing roller 40 is pushed upwards about the center of the pin 44, and the medal 14 escapes from the pressing roller 40 and is shot out vigorously.

Since the lower portion of the medal 14 is placed in contact with the slip-proof rubber piece 42 so that it cannot slide in this case, the medal 14 is driven in rotation so that it can be shot in a straight line.

When the medal 14 escapes from the pressing roller 40, the energizing force of the spring 46 acts so as to press against the rear side of the medal 14, so that an even stronger rotational force is imparted to the medal 14.

This pressing roller 40 could also be provided on the lower side of the shooting section 24, although this is not shown in the figures.

In such a case, the configuration could be such that a sliding means that allows the upper portion of the medal 14 to slide could be provided on the upper side of the shooting section 24 corresponding to the pressing roller 40.

Since the lower portion of the medal 14 is pressed by the pressing roller 40 and the upper portion is allowed to slide when the medal 14 is pushed out by the push-out means 30, this configuration would make it possible to drive the medal 14 forward in rotation in the direction C.

It is also possible to vary the speed at which the medal is shot, depending on the game, by varying the attachment positions of each of a plurality of attachment pins 48, such as three such attachment pins, to vary the pressing force applied by the pressing roller 40 to the medal 14.

The shot running section 26 is set to a predetermined length to enable the medal 14 that has been shot from the shooting section 24 to run forward.

The medal mounting section 28 is provided protruding from the side of the shooting section 24, making it possible to load a plurality of medals 14.

The loaded medals 14 are pressed towards the shooting section 24 by a spring 51 so that the medals 14 are loaded automatically into the shooting section 24.

The half-mirror 18 is configured in such a manner that it reflects a screen of a display 50 that is disposed above the half-mirror 18 with the screen thereof pointing downward.

The screen of this display 50 shows targets, with the configuration being such that these targets are reflected in the half-mirror 18 towards a player 52.

A light 53 is disposed on the rear side of the half-mirror 18 in such a manner that each medal 15 that has passed a lower-edge position of the half-mirror 18 becomes visible through the half-mirror 18, producing[]an effect as if the medal 14 has hit one of the targets displayed on the half-mirror 18.

The medal running surface 20 is provided in a state in which it slopes gently downward from the shooting device 16 side to the half-mirror 18 side, and a gap 54 that enables the medal 14 to pass therethrough is provided between the lower edge of the half-mirror 18 and the medal running surface 20.

A detection means 56 is provided on the medal running surface 20 behind the half-mirror 18, to detect the position at which the medal 14 passes the final edge position thereof.

In this embodiment of the present invention, the detection means 56 is a plurality of microswitches with the configuration being such that the position at which the medal 14 passes is detected when the medal 14 touches it.

After passing, the medal 14 is accommodated in a hopper 60 via a slope 58, is returned to a return box 62 from the hopper 60, then is transferred from there to the location of the player 52.

Note that the configuration is such that surplus medals 14 are collected in a reception box 64 within the hopper 60.

Figure 5:
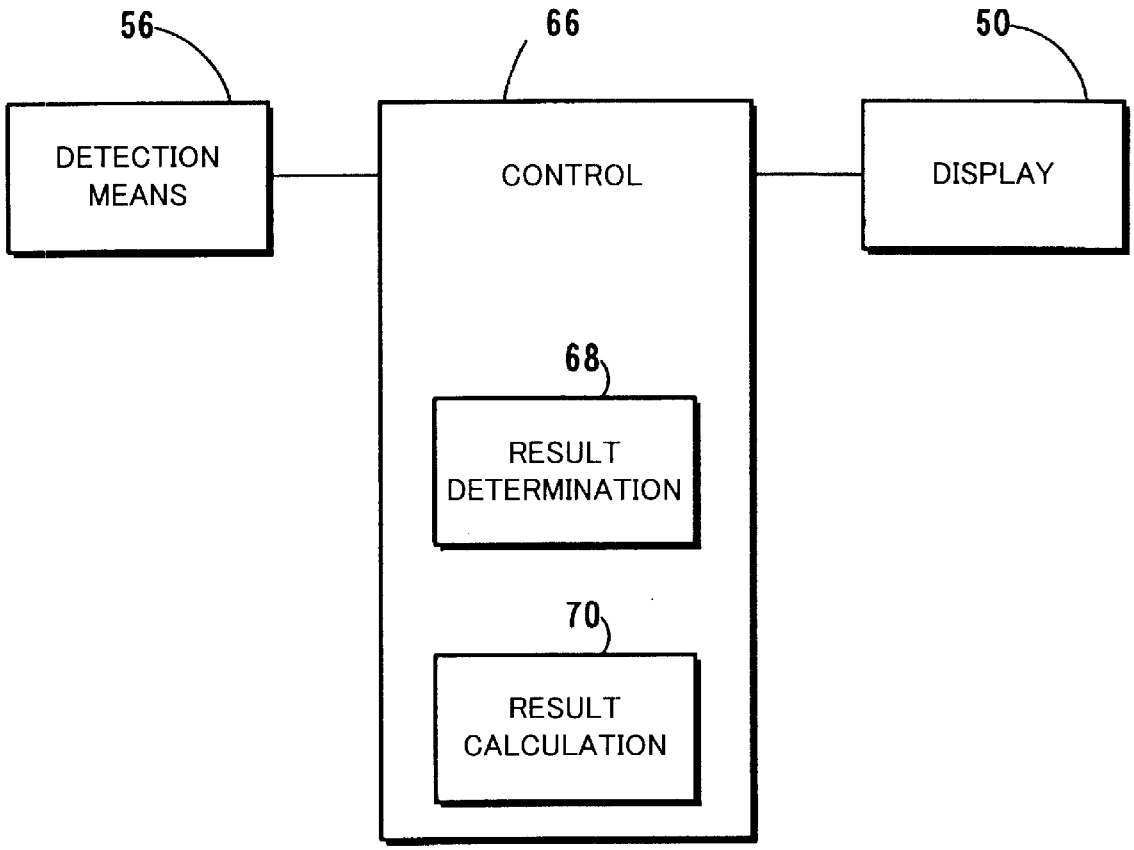
FIG. 5 is a functional block diagram of the medal game machine in accordance with this embodiment of the invention.

A functional block diagram of the medal game machine 10 in accordance with this embodiment of the invention is shown in FIG. 5.

This medal game machine 10 comprises the detection means 56, a control section 66, and the display 50.

The detection means 56 is designed to detect the position at which each medal 14 shot from the shooting device 16 passes, when the medal 14 has run along the medal running surface 20.

The control section 66 is designed to provide control over the entire medal game machine 10.

The control section 66 comprises a result determination section 68 and a result calculation section 70, which determine the result of the game.

The configuration is such that a game screen having targets is displayed on the display 50, the result determination section 68 determines whether the position of the medal 14 that has been aimed at the target 14 reflected in the half-mirror 18, as detected by the detection means 56, matches the position of the target, and an image of the target bursting and also a game result that has been calculated by the result calculation section 70 is displayed on the display 50.

Sound effects are output from a suitable speaker or the like, depending on the game situation.

The display 50 is designed to display game screens as specified by the control section 66.

Figure 6:
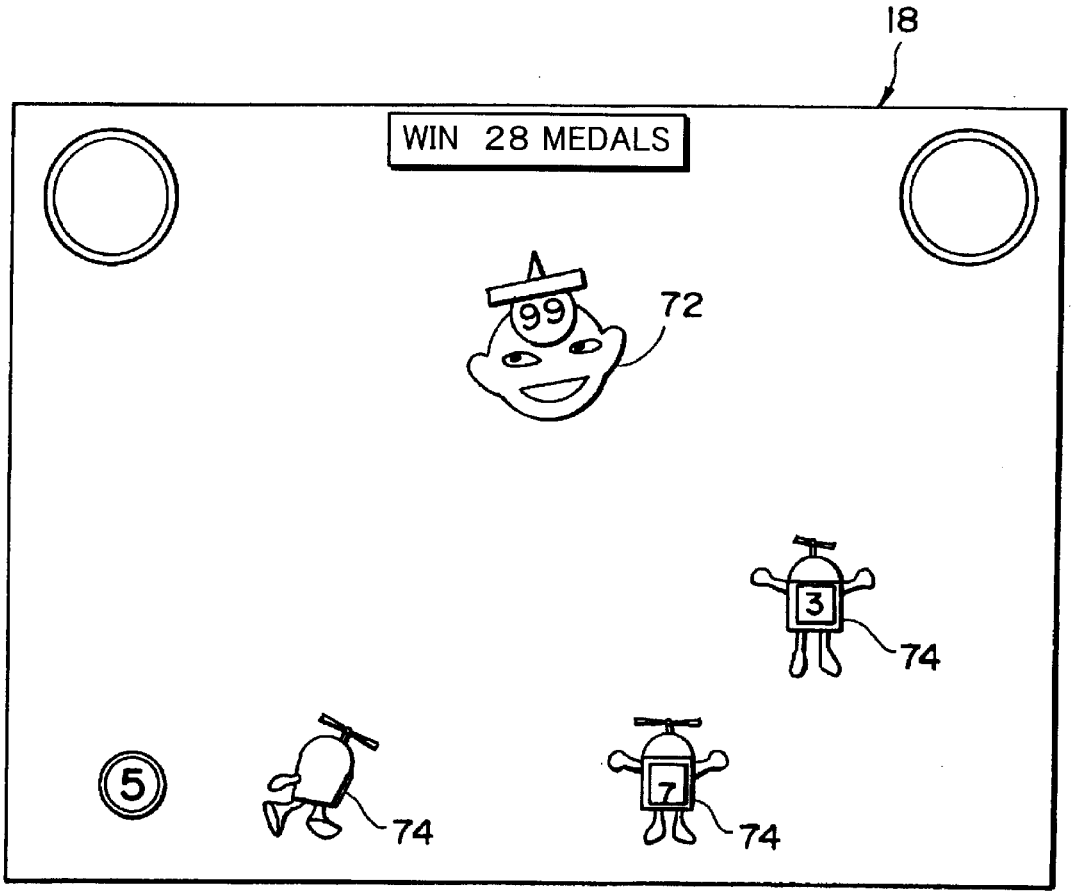
FIG. 6 shows a display screen for a first game.
Figure 7A:
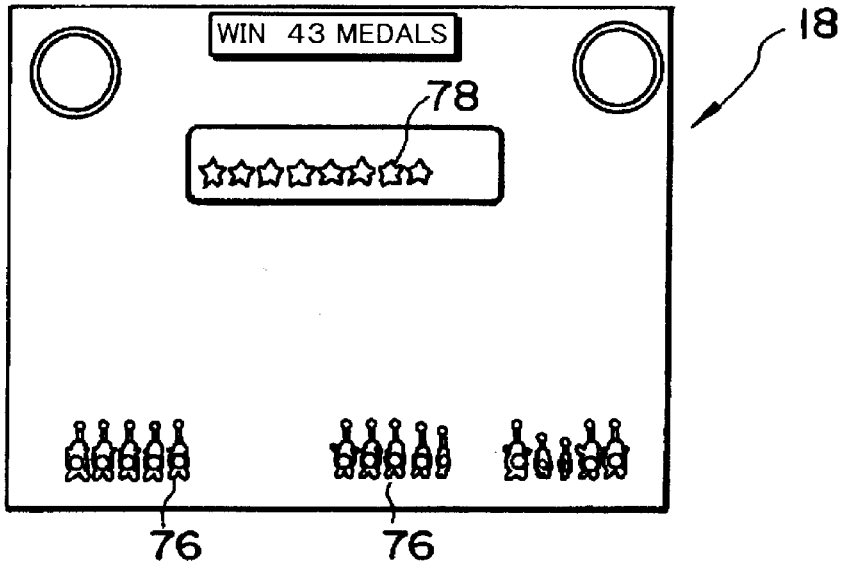
FIGS. 7A and 7B show a display screen for a normal game and a display screen for a bonus game, during a second game.
Figure 7B:
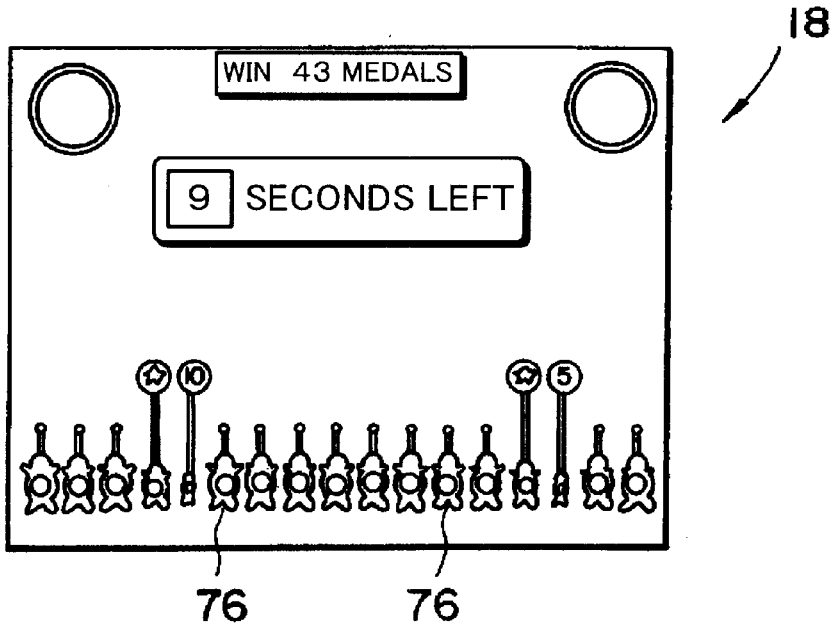

Examples of these game screens are shown in FIGS. 6, 7A, and 7B.

FIG. 6 shows a screen for a first game, where this first game is a target game involving a balloon 72 that floats in mid-air and minnow characters 74 that act to protect the balloon 72.

It is possible to win a large number of medals if the balloon 72 is burst, and the balloon 72 gradually sinks naturally while floating at the center of the screen.

There are five minnow characters 74 which act to protect the balloon 72, and which dance around blowing wind in such a manner as to prevent the balloon 72 from sinking.

A pointer-style roulette wheel is attached to the chest of each minnow character 74, with the configuration being such that a number of medals corresponding to that pointer is paid out at the instant the balloon bursts.

To acquire the balloon 72, the player first aims at the minnow characters 74 with the medals 14 that are blowing wind, to land the balloon 72, then steps on means to burst the landed balloon 72 with medals 14.

FIGS. 7A and 7B show screens from a second game, where this second game comprises a normal game shown in FIG. 7A and a bonus game shown in FIG. 7B.

In the normal game, "holes in space" appear at three random positions on the screen and characters 76 appear from these holes.

The characters 76 are shaped like playing cards and a line of five of these characters 76 appears in a lateral row from each hole at a time.

The characters 76 are smaller than the minnow characters 74 of the first game, so that they are more difficult to hit with the medals 14.

A number from 0 to 7 or a "star" is written on each of the characters 76.

There is a rule- governing the combination of five characters that appears from each hole: one always has a "star", two have zero, and the numbers on the remaining two add up to eight, but their arrangement is random.

As soon as the characters 76 appear from a hole in space, the player identifies them and attacks with medals 14.

If a medal 14 hits a character 76, the character 76 shatters into fragments and the player receives the number of medals 14 that was written thereon.

If a "star" is hit, a star mark 78 is added to the top of the screen.

Note that a bonus game starts when the number of these star marks 78 reaches ten.

With the bonus game, a large number of characters on which is written "?" fall from above when the number of the star marks 78 reaches ten.

At the same time that these characters 76 land, a ten-second timer starts counting down, during which time the player tries to burst as many of the characters 76 as possible.

Note that the characters freeze in place.

If a character 76 is hit by a medal 14, the character 76 shatters into fragments and a number from 5 to 10 or a "star" is displayed.

The configuration is such that if a number appears, the player gets that number of medals 14, and if a "star" appears, the "star" is stuck to the top of the screen and is carried forward after the bonus game ends. If ten "stars" accumulate during the bonus game, the player can get a large number of medals.

Simultaneously with the end of the time limit, the characters 76 disappear upwards and the bonus game ends.

Another embodiment of the shooting device is shown in FIGS. 8 to 11.

Figure 8:
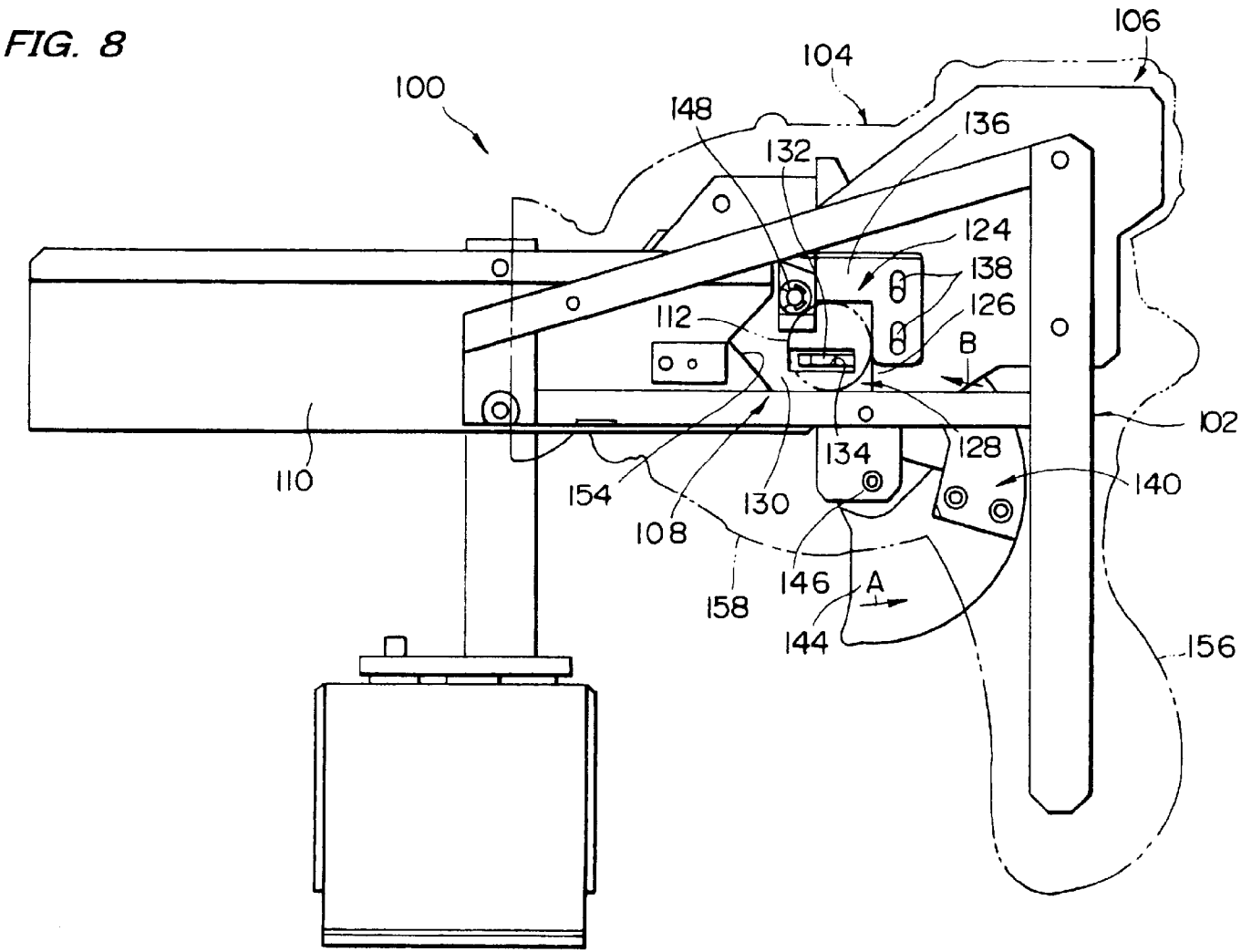
FIG. 8 is a complete schematic view of another embodiment of the shooting device in accordance with the present invention.

In this embodiment of the present invention, a shooting device 100 is shaped to simulate a hand-gun as in the previous embodiment, and is configured of a main unit 102 of the shooting device and a case 104, as shown in FIG. 8.

Figure 9:
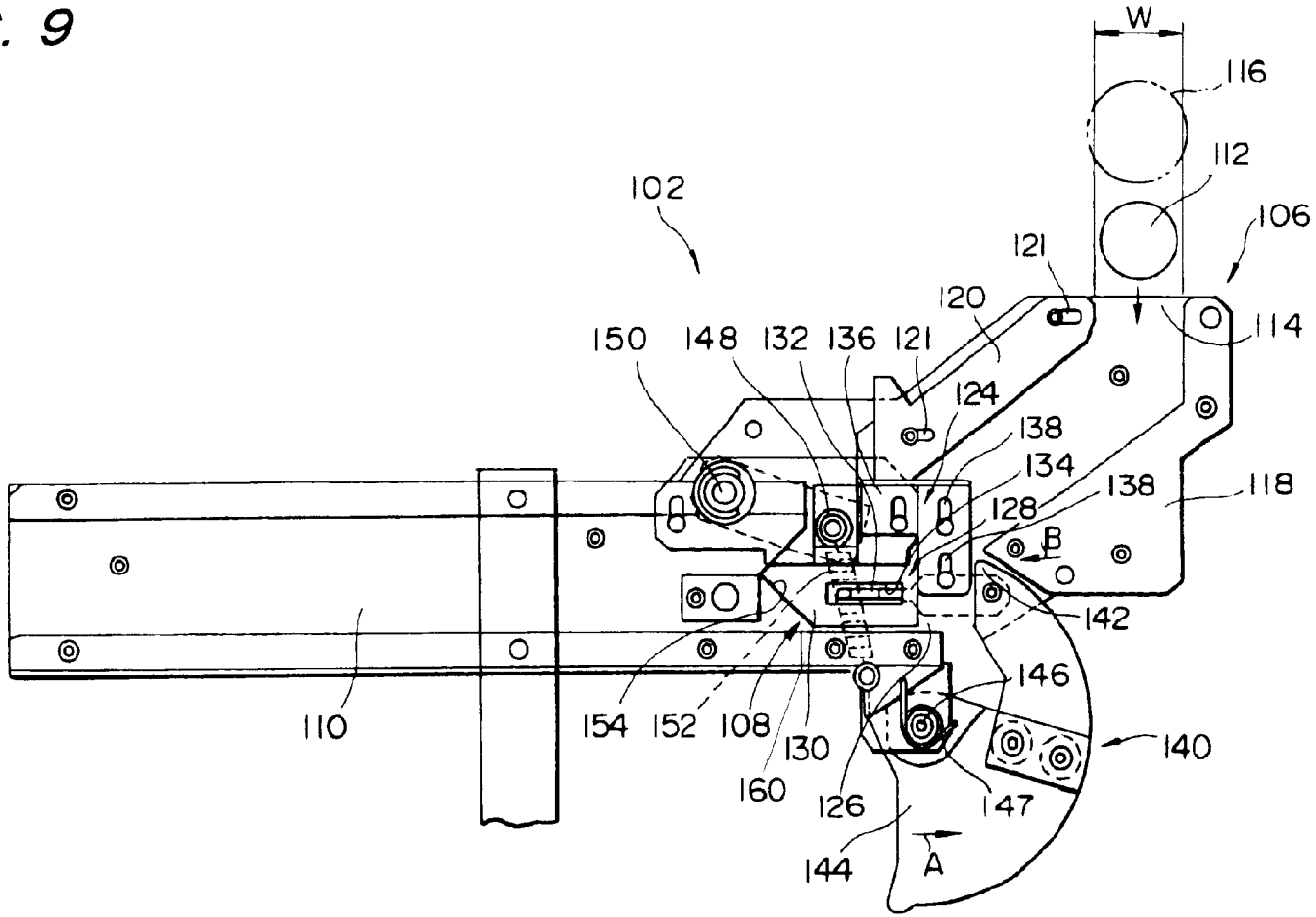
FIG. 9 is a side view showing the interior configuration of the main shooting device unit of FIG. 8.
Figure 10:
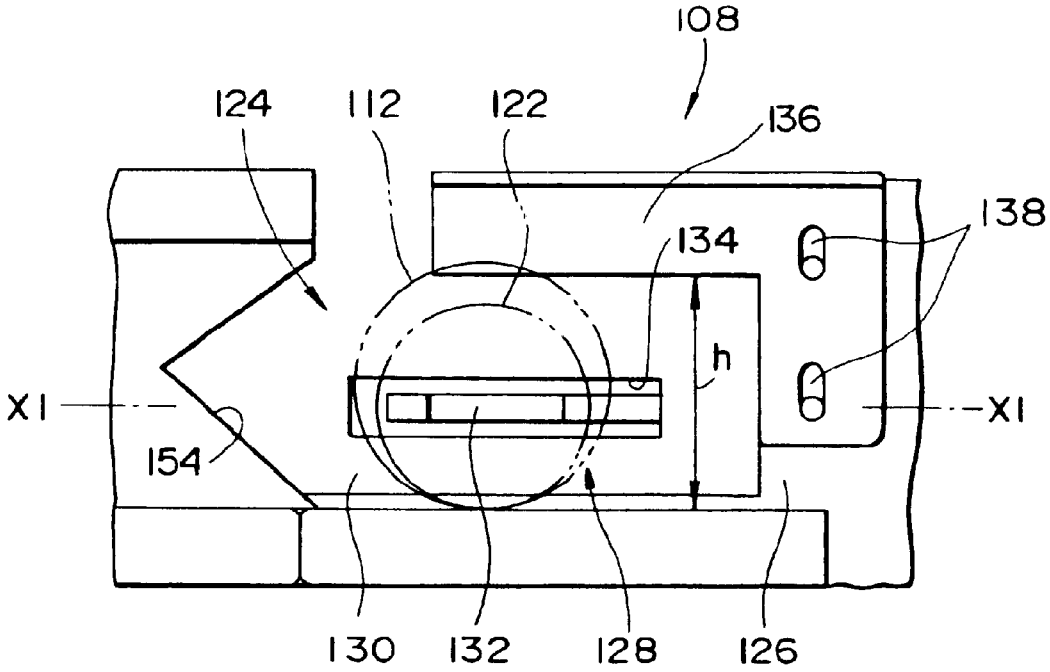
FIG. 10 is an enlarged side view of the small-diameter medal ejection means.

The main unit 102 of the shooting device is provided with a medal insertion section 106, a shooting section 108, and a shot running section 110, as shown in FIG. 9.

Since the medal insertion section 106 is intended for loading medals 112 into the shooting section 108, it is possible to insert medals 112 into a medal insertion aperture 114.

An insertion guide member 118 and an insertion aperture adjustment member 120, which function as large-diameter medal rejection means for rejecting the insertion of large-diameter medals 116 that are larger than authorized medals 112, are provided in the medal insertion section 106.

An aperture width W of the medal insertion aperture 114 is set to the size of the authorized medals 112 by the insertion guide member 118 and the insertion aperture adjustment member 120, so that the large-diameter medals 116 can not be placed into the medal insertion aperture 114.

It is therefore possible to reliably prevent the player from deliberately inserting large-diameter medals 116.

The medal insertion aperture 114 can be adjusted to the size of the authorized medals 112 by attaching the insertion aperture adjustment member 120 via a slot 121 that extends horizontally, to adjust the mounting position of the insertion aperture adjustment member 120 horizontally.

It is therefore possible to allow for the use of authorized medals of different sizes in different stores, in a simple manner.

The shooting section 108 is designed so that the medals 112 are loaded in a vertical orientation, as in the previous embodiment, and is also provided with a small-diameter medal ejection means 124 so that, if the medals supplied thereto are small-diameter medals 122 of a diameter less than that of the authorized medals 112, those small-diameter medals 122 can be ejected to the exterior from the shooting section 108 before firing.

Figure 11:
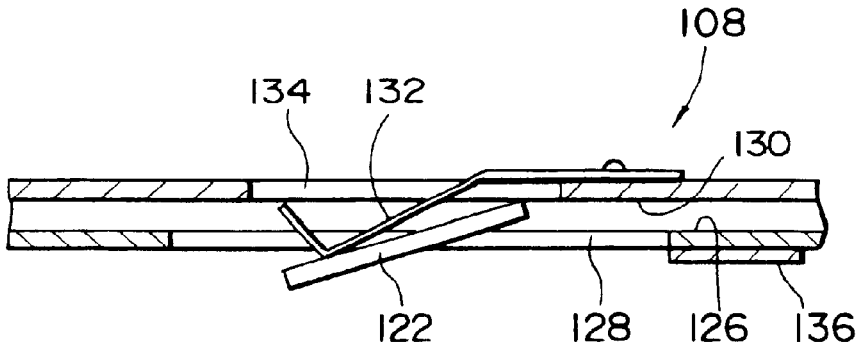
FIG. 11 is a section taken along the line X1—X1 of FIG. 10.

This small-diameter medal ejection means 124 comprises a small-diameter medal ejection hole 128 formed on one side surface 126 of the shooting section 108 and an ejection spring 132 that acts as an ejection member provided on another side surface 130 at a position corresponding to a small-diameter .medal 122, as shown in FIG. 11.

The ejection spring 132 is in a state such that it projects towards the one side surface 126 from a window 134 formed to extend laterally. in the other side surface 130, so as to push the side of a medal 112 or 122 that has been supplied into the shooting section 108 in the direction of the small-diameter medal ejection hole 128.

The aperture height h of the small-diameter medal ejection hole 128 is set to a height such that the authorized medals 112 do not pass through, by an aperture height adjustment member 136 that acts as aperture height adjustment means.

If a small-diameter medal 122 should be supplied into the shooting section 108, therefore, the small-diameter medal 122 is passed through the small-diameter medal ejection hole 128 by pushing the side surface thereof towards the small -diameter medal ejection hole 128, and thus is ejected to the exterior from the small-diameter medal ejection hole 128.

In this manner, if a small-diameter medal 122 is inserted, the use of that small-diameter medal 122 can be prevented, reliably by ejecting the small-diameter medal 122 to the exterior.

The aperture height of the small-diameter medal ejection hole 128 can be adjusted to the size of the authorized medals 112 by attaching the aperture height adjustment member 136 via slots 138 arranged in the vertical direction and adjusting the attachment position of the aperture height adjustment member 136 vertically.

It is therefore possible to allow for the use of authorized medals of different sizes in different stores, in a simple manner.

A push-out means 140 is provided on the rear side of the shooting section 108 to push out and shoot medals 112 that have been loaded into the shooting section 108, as shown in FIGS. 8 and 9.

This push-out means 140 is in a state such that a push-out section 142 and a trigger 144 are formed integrally therewith, it is installed in such a manner that it can rotate about the center of a pin 146 and it is also in a state in which it is energized rearward by a spring 147 on the trigger 144 side.

The configuration is such that the energizing force of the spring 147 is resisted by pulling the trigger 144 in the direction of the arrow A so that the push-out section 142 moves in the direction B in the figure to push out the medal 122.

A pressing roller 148 is provided as a pressing means in an upper part of the shooting section 108, and a slip-proof rubber piece 160 is provided as a sliding-prevention means in a lower part thereof, to prevent the medal 112 sliding.

The pressing roller 148 is attached so as to be able to rotate up and down about a pin 150 and is in a state such that it is energized downward by a spring 152.

If the medal 112 is pushed out by the push-out means 140 as far as the position of the pressing roller 148, the upper portion of the medal 112 is pressed by the pressing roller 148 in a state in which it absorbs the pressing force of the push-out means 140. If the medal 112 is pushed out further by the push-out means 140, it resists the energizing force of the spring 152, the pressing roller 148 is pushed upwards about the center of the pin 150, and the medal 112 escapes from the pressing roller 148 and is shot out vigorously.

To ensure that the fired medal 112 does not strike the edge of the aperture of the small-diameter medal ejection hole 128 formed in the other side surface 130 in this case, a lateral V-shaped notch 154 is formed in that edge of the aperture.

The shot running section 110 is set to a predetermined length to enable the medal 14 that has been shot from the shooting section 24 to run forward.

A grip 156 is formed integrally with the case 104 in such a manner as to cover parts of the shooting section 108 and the shot running section 110 from the medal insertion aperture 114 side.

A storage section 158 for collecting small-diameter medals 122 that have been ejected from the small-diameter medal ejection means 124 is formed on the lower side of the case 104 corresponding to the shooting section 108.

This makes it possible to prevent the re-use of small-diameter medals 122 that have been ejected by the small-diameter medal ejection means 124, by collecting the ejected small-diameter medals 122 in the storage section 158.

All other details of the configuration and operation are similar to those of the previous embodiment, so further description thereof is omitted.

The present invention is not limited to the above described embodiments and thus it can be modified in various different ways within the scope of the invention laid out herein.

For instance, the above embodiments illustrated the use of a pressing roller that can rotate up and down as the pressing means, but the present invention is not limited to that example and thus it is equally possible to provide the fixing of an elastic member.

In addition, the screen of the display was reflected in a half-mirror, but it is also possible to use a semi-transparent reflective plate.

Furthermore, the details of the games are not limited to the above described first and second games, and thus the present invention can be applied to various different games.

A slip-proof rubber piece was used as the sliding-prevention means, but various different components could be used therefor, such as fine grooves, provided they have sliding-prevention capabilities.

In addition, the above described embodiments deal with a configuration in which a medal was pushed out by a push-out means while in a state in which it was being pressed by a pressing means. However, the present invention is not limited to that example and thus various other configurations could be used therefor, such as a shooting means in which a medal is positioned to a certain degree within the shooting section by an ejection spring that functions as a positioning means and fired out from behind as in a case of a pachinko machine, by way of example.

What is claimed is:

1. A medal game machine that uses medals fired from a shooting device to shoot at a target, comprising:

a reflective plate disposed in an inclined state in front of the shooting device, for reflecting and displaying an image of a display on which is shown a target;

a medal running surface disposed below the reflective plate, enabling medals to pass under the reflective plate;

detection means disposed on the rear side of the reflective plate and above the medal running surface, and detecting the position through which a medal passes; and a result determination section which determines whether or not the position through which the medal passes matches the position of the target, wherein the shooting device comprises a shooting section which loads a medal in a vertical orientation and a shooting means which shoots a medal that has been loaded into the shooting section, wherein the shooting section is provided with positioning means which positions a medal that has been loaded into the shooting section, when the medal is being shot by the shooting means, and wherein the medal is shot past the positioning means.

2. The medal game machine as defined in claim 1, wherein the shooting section is provided with a mechanism to prevent use of unauthorized small-diameter medals, wherein the shooting section ejects a small-diameter medal, which is smaller than an outer diameter of an authorized medal, to an exterior from the shooting section.

3. The medal game machine as defined in claim 2, wherein the small-diameter medal ejection means includes a small-diameter medal ejection hole formed in one side surface of the shooting section and an ejection member provided on another side surface at a position corresponding to the small-diameter medal ejection hole, for pushing a side surface of a small-diameter medal towards the small-diameter medal ejection hole.

4. The medal game machine as defined in claim 3, wherein the small-diameter medal ejection means has an aperture height adjustment means which adjusts an aperture height of the small-diameter medal ejection hole.

5. The medal game machine as defined in claim 1, wherein the shooting device comprises a medal insertion section for loading medals into the shooting section, a large-diameter medal rejection means which rejects a large-diameter medal that is larger than an outer diameter of an authorized medal is provided in the medal insertion section, and the large-diameter medal rejection means adjusts a size of a medal to be rejected according to a size of an authorized medal.

6. The medal game machine as defined in claim 1, wherein the reflective plate is a half-mirror so that a running state of a medal after passing the half-mirror is visible.

7. A medal game machine that uses medals fired from a shooting device to shoot at a target, wherein the shooting device comprises a shooting section which loads a vertically oriented medal and a push-out means which pushes out and shoots a medal that has been loaded into the shooting section, wherein the shooting section is provided with pressing means which presses against an upper portion or a lower portion of a medal that has been loaded into the shooting section, in order to cause rotation of the medal when the medal is being pushed out by the push-out means, and wherein the medal is shot past the pressing means.

8. A medal game machine that uses medals fired from a shooting device to shoot at a target, wherein the shooting device comprises a shooting section which loads a medal in a vertical orientation and a push-out means which pushes out and shoots a medal that has been loaded into the shooting section, wherein the shooting section is provided with pressing means which presses against an upper portion or a lower portion of a medal that has been loaded into the shooting section, when the medal is being pushed out by the push-out means, wherein the medal is shot past the pressing means, wherein the pressing means is provided at a lower part of the shooting section, wherein a sliding means for allowing the medal to slide is provided at an upper part of the shooting section.

9. The medal game machine as defined in claim 7, wherein the shooting section is provided with a mechanism to prevent use of unauthorized small-diameter medals, wherein the shooting section ejects a small-diameter medal, which is smaller than an outer diameter of an authorized medal, to an exterior from the shooting section.

10. The medal game machine as defined in claim 9, wherein the small-diameter medal ejection means includes a small-diameter medal ejection hole formed in one side surface of the shooting section and an ejection member provided on another side surface at a position corresponding to the small-diameter medal ejection hole, for pushing a side surface of a small-diameter medal towards the small-diameter medal, ejection hole.

11. The medal game machine as defined in claim 10, wherein the small-diameter medal ejection means has an aperture height adjustment means which adjusts an aperture height of the small-diameter medal ejection hole.

12. The medal game machine as defined in claim 7, wherein the shooting device comprises a medal insertion section for loading medals into the shooting section, a large-diameter medal rejection means which rejects a large-diameter medal that is larger than an outer diameter of an authorized medal is provided in the medal insertion section, and the large-diameter medal rejection means adjusts a size of a medal to be rejected according to a size of an authorized medal.

13. The medal game machine as defined in claim 8, wherein the pressing means is a pressing roller that is energized in a medal-pressing direction by a spring.

14. A medal game machine that uses medals fired from a shooting device to shoot at a target, wherein the shooting device comprises a shooting section which loads a medal in a vertical orientation and a push-out means which pushes out and shoots a medal that has been loaded into the shooting section, wherein the shooting section is provided with pressing means which presses against an upper portion or a lower portion of a medal that has been loaded into the shooting section, when the medal is being pushed out by the push-out means, wherein the medal is shot past the pressing means, wherein the pressing means is provided at an upper part of the shooting section, and wherein a sliding-prevention means for preventing the medal from sliding is provided at a lower part of the shooting section.

15. The medal game machine as defined in claim 14, wherein the pressing means is a pressing roller that is energized in a medal-pressing direction by a spring.

16. A medal game machine that uses medals fired from a shooting device to shoot at a target, wherein the shooting device comprises a shooting section which loads a medal in a vertical orientation and a push-out means which pushes out and shoots a medal that has been loaded into the shooting section, wherein the shooting section is provided with pressing means which presses against an upper portion or a lower portion of a medal that has been loaded into the shooting section, when the medal is being pushed out by the push-out means, wherein the medal is shot past the pressing means, and wherein the pressing means is a pressing roller that is energized in a medal-pressing direction by a spring.

17. The medal game machine as defined in claim 16, wherein an attachment position of the spring is adjustable so as to adjust the pressing force of a the pressing roller.

18. A medal game machine that uses medals fired from a shooting device to shoot at a target, comprising:

a reflective plate disposed in an inclined state in front of the shooting device, for reflecting and displaying an image of a display on which is shown a target;

a medal running surface disposed below the reflective plate, enabling medals to pass under the reflective plate;

detection means disposed on the rear side of the reflective plate and above the medal running surface, and detecting the position through which a medal passes; and a result determination section which determines whether or not the position through which the medal passes matches the position of the target, wherein the shooting device comprises a shooting section which loads a medal in a vertical orientation and a push-out means which pushes out and shoots a medal that has been loaded into the shooting section, wherein the shooting section is provided with pressing means which presses against an upper portion or a lower portion of a medal that has been loaded into the shooting section, when the medal is being pushed out by the push-out means, and wherein the medal is shot past the pressing means.

19. The medal game machine as defined in claim 18, wherein the reflective plate is a half-mirror so that a running state of a medal after passing the half-mirror is visible.

* * * * *